US011155089B2

(12) United States Patent
Yamamoto

(10) Patent No.: US 11,155,089 B2
(45) Date of Patent: Oct. 26, 2021

(54) LIQUID EJECTION HEAD

(71) Applicant: Brother Kogyo Kabushiki Kaisha, Nagoya (JP)

(72) Inventor: Jiro Yamamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 17 days.

(21) Appl. No.: 16/835,682

(22) Filed: Mar. 31, 2020

(65) Prior Publication Data

US 2020/0307196 A1 Oct. 1, 2020

(30) Foreign Application Priority Data

Apr. 1, 2019 (JP) ..... JP2019-069582

(51) Int. Cl.
*B41J 2/14* (2006.01)
*B41J 2/18* (2006.01)

(52) U.S. Cl.
CPC ..... *B41J 2/14233* (2013.01); *B41J 2/1433* (2013.01); *B41J 2/14201* (2013.01); *B41J 2/18* (2013.01); *B41J 2002/14241* (2013.01); *B41J 2002/14306* (2013.01); *B41J 2002/14419* (2013.01); *B41J 2202/12* (2013.01)

(58) Field of Classification Search
CPC ..... B41J 2/14233; B41J 2/18; B41J 2/1433; B41J 2/14201; B41J 2002/14241; B41J 2002/14419; B41J 2202/12; B41J 2002/14306
See application file for complete search history.

(56) References Cited

U.S. PATENT DOCUMENTS 10,703,098 B2 * 7/2020 Okazawa ..... B41J 2/04551
2012/0176450 A1 7/2012 Akahane et al.

FOREIGN PATENT DOCUMENTS

JP 2013-184336 A 9/2013
JP 5962935 B2 8/2016

* cited by examiner

*Primary Examiner* — Geoffrey S Mruk
(74) *Attorney, Agent, or Firm* — Banner & Witcoff, Ltd.

(57) ABSTRACT

A liquid ejection head includes a channel member, a nozzle plate, a damper film, and a cover plate. The channel member includes pressure chambers, a first manifold provided in common for the pressure chambers, descending channels each connected to a corresponding one of the pressure chambers, and a second manifold provided in common for the pressure chambers. The nozzle plate has nozzles each connected to a corresponding one of the descending channels. The damper film defines a portion of the first manifold. The cover plate defines a portion of the second manifold. The damper film and the cover plate are disposed on the same side of the channel member as the nozzle plate in an orthogonal direction. The nozzle plate and the damper film do not overlap each other when viewed in the orthogonal direction, and are joined to the cover plate.

15 Claims, 8 Drawing Sheets

LIQUID EJECTION HEAD

CROSS-REFERENCE TO RELATED APPLICATION

This application claims priority from Japanese Patent Application No. 2019-069582 filed on Apr. 1, 2019, the content of which is incorporated herein by reference in its entirety.

TECHNICAL FIELD

Aspects described herein relate to a liquid ejection head that ejects droplets of liquid from nozzles.

BACKGROUND

A known liquid ejection head ejects droplets of liquid from nozzles communicating with pressure chambers by changing pressures of liquid in the pressure chambers to which liquid is supplied from a manifold. In a known inkjet head, a manifold is located at one side of each of pressure-generating chambers (pressure chambers), and communication channels that communicate with nozzle openings (nozzles) are located at the other side thereof opposite to the manifold. The nozzle openings are formed in a nozzle plate joined to a lower surface of a communication plate formed with the communication channels. A lower surface of the supply manifold to supply liquid to the pressure-generating chambers is defined by a lidding member joined to a lower surface of the communication plate. The lidding member is deformable with a change in pressure in the manifold.

SUMMARY

Depending on properties of liquid to be used, problems such as an increased viscosity of liquid and settlement of some particles contained in liquid may occur in some channels from the supply manifold (a first manifold) to the nozzles. To reduce these problems, a return manifold (a second manifold) may be provided. The return manifold is used to return liquid flowing from the supply manifold to the nozzles to a liquid supply source to the liquid ejection head such as an ink tank. Liquid can be thus circulated between the liquid ejection head and the liquid supply source.

According to one or more aspects of the disclosure, a liquid ejection head includes a channel member, a nozzle plate, a damper film, and a cover plate. The channel member includes a plurality of pressure chambers arranged in an arrangement direction, a first manifold provided in common for the pressure chambers, a plurality of descending channels each connected to a corresponding one of the pressure chambers and located opposite to first manifold relative to the corresponding one of the pressure chambers in a particular direction orthogonal to the arrangement direction, and a second manifold provided in common for the pressure chambers. The nozzle plate has a plurality of nozzles each connected to a corresponding one of the descending channels. The damper film defines a portion of the first manifold. The cover plate defines a portion of the second manifold. The damper film and the cover plate are disposed on the same side of the channel member as the nozzle plate in an orthogonal direction orthogonal to the particular direction. The nozzle plate and the damper film do not overlap each other when viewed in the orthogonal direction, and are joined to the cover plate.

According to one or more aspects of the disclosure, a liquid ejection head includes a nozzle plate, a channel member, a first damper film, a second damper film, a first cover plate, a second cover plate. The nozzle plate has a plurality of first nozzles in a first row and a plurality of second nozzles in a second row different from the first row. The channel member includes a plurality of first pressure chambers each corresponding to a corresponding one of the first nozzles in the first row, a plurality of second pressure chambers each corresponding to a corresponding one of the second nozzles in the second row, a first manifold provided in common for the first pressure chambers, a second manifold provided in common for the second pressure chambers, a first narrowed portion, a second narrowed portion, a first descending channel, a second descending channel, a third manifold, a fourth manifold, a third narrowed portion, and a fourth narrowed portion. The second manifold and the first manifold sandwich the first pressure chambers and the second pressure chambers therebetween in a particular direction. The first narrowed portion is located between one of the first pressure chambers and the first manifold in an orthogonal direction orthogonal to the particular direction. The second narrowed portion is located between one of the second pressure chambers and the second manifold in the orthogonal direction. The first descending channel is located between the first manifold and the second manifold in the particular direction and connected to one of the first pressure chambers. The second descending channel is located between the first descending channel and the second manifold in the particular direction and connected to one of the second pressure chambers. The third manifold is located between the first manifold and the first descending channel in the particular direction and provided in common for the first pressure chambers. The fourth manifold is located between the second manifold and the second descending channel in the particular direction and provided in common for the second pressure chambers. The third narrowed portion is located between the first descending channel and the third manifold in the particular direction. The fourth narrowed portion is located between the second descending channel and the fourth manifold in the particular direction. The first damper film defines a portion of the first manifold. The second damper film defines a portion of the second manifold. The first cover plate defines a portion of the third manifold. The second cover plate defines a portion of the fourth manifold. The first narrowed portion extends in a direction crossing a direction in which the third narrowed portion extends from the first descending channel to the third manifold. The second narrowed portion extends in a direction crossing a direction in which the fourth narrowed portion extends from the second descending channel to the fourth manifold. The first damper film, the second damper film, the first cover plate, and the second cover plate are disposed in a portion of the channel member in the orthogonal direction, the portion including the nozzle plate. The nozzle plate and the first damper film do not overlap each other in the orthogonal direction and are joined to the first cover plate. The nozzle plate and the second damper film do not overlap each other in the orthogonal direction and are joined to the second cover plate.

DETAILED DESCRIPTION

First Embodiment

A first embodiment is described with reference to the accompany drawings.

Structure of Printer

Figure 1:
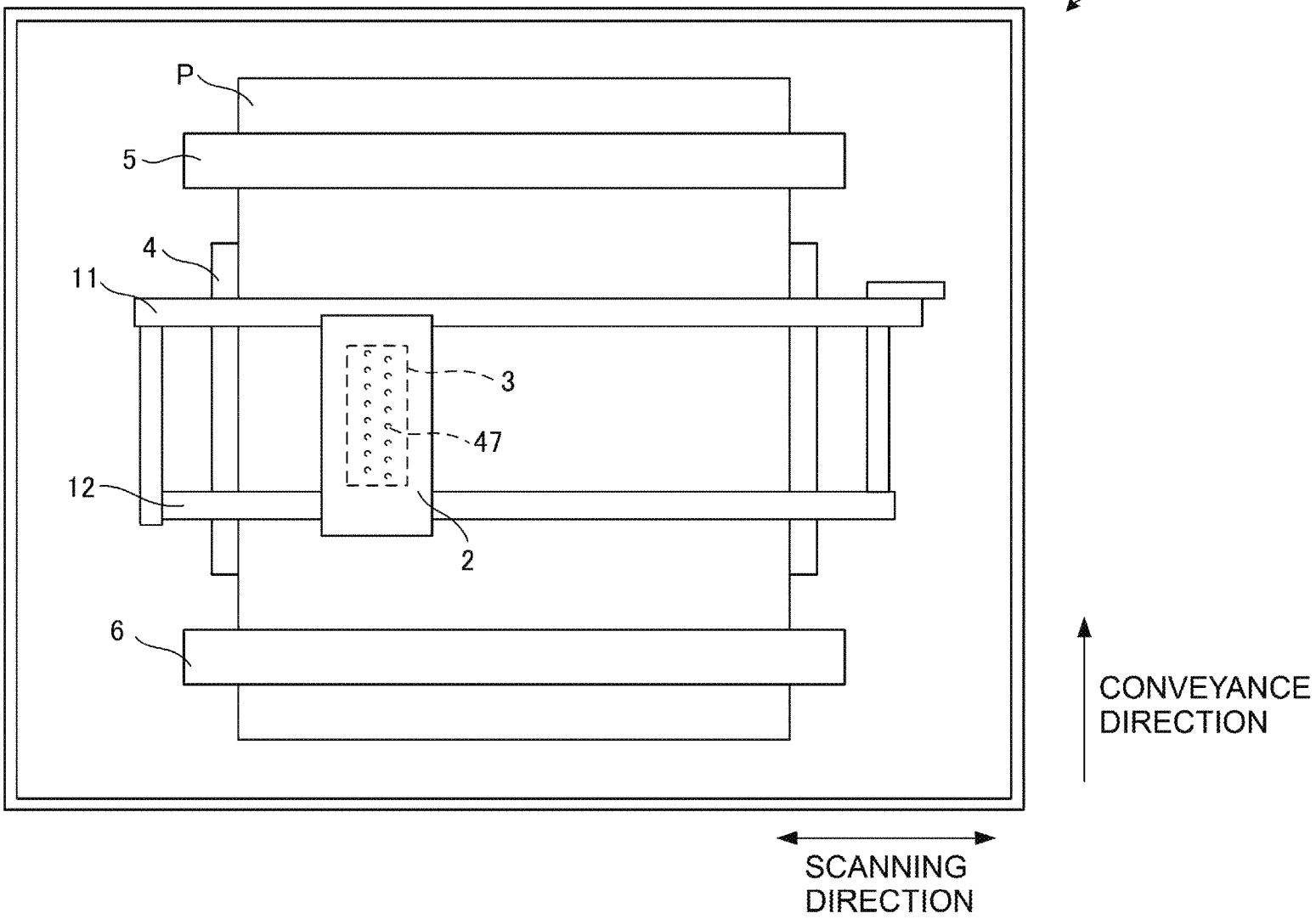
FIG. 1 is a plan view of a printer including an inkjet head according to a first embodiment of the disclosure.

As illustrated in FIG. 1, a printer 1 according to the first embodiment includes a carriage 2, an inkjet head 3 (as an example of a liquid ejection head), a platen 4, and conveyor rollers 5, 6.

The carriage 2 is supported by two guide rails 11, 12 extending in a scanning direction (a left-right direction in FIG. 1), and moves along the guide rails 11, 12 in the scanning direction. The inkjet head 3 is mounted on the carriage 2 and moves together with the carriage 2 in the scanning direction. The inkjet head 3 ejects ink from a plurality of nozzles 47 formed in its lower surface. The inkjet head 3 will be described in detail later.

The platen 4 is disposed facing a lower surface of the inkjet head 3 and extends across the entire length of a recording sheet P in the scanning direction. The platen 4 supports a recording sheet P from below. The conveyor roller 5 is disposed upstream of the carriage 2 and the conveyor roller 6 is disposed downstream of the carriage 2 in a conveyance direction orthogonal to the scanning direction, to convey a recording sheet P in the conveyance direction.

The printer 1 prints a recording sheet P by alternately performing a conveyance process and a scanning process. In the conveyance process, the printer 1 allows the conveyor rollers 5, 6 to convey a sheet P by a specified distance at a time in the conveyance direction. In the scanning process, the printer 1 allows the inkjet head 3 to eject droplets of ink from the nozzles 47 while moving the carriage 2 in the scanning direction. Namely, the printer 1 is a serial printer. In the following description, a direction orthogonal to both of the scanning direction and the conveyance direction is referred to as an up-down direction.

Inkjet Head 3

Figure 2:
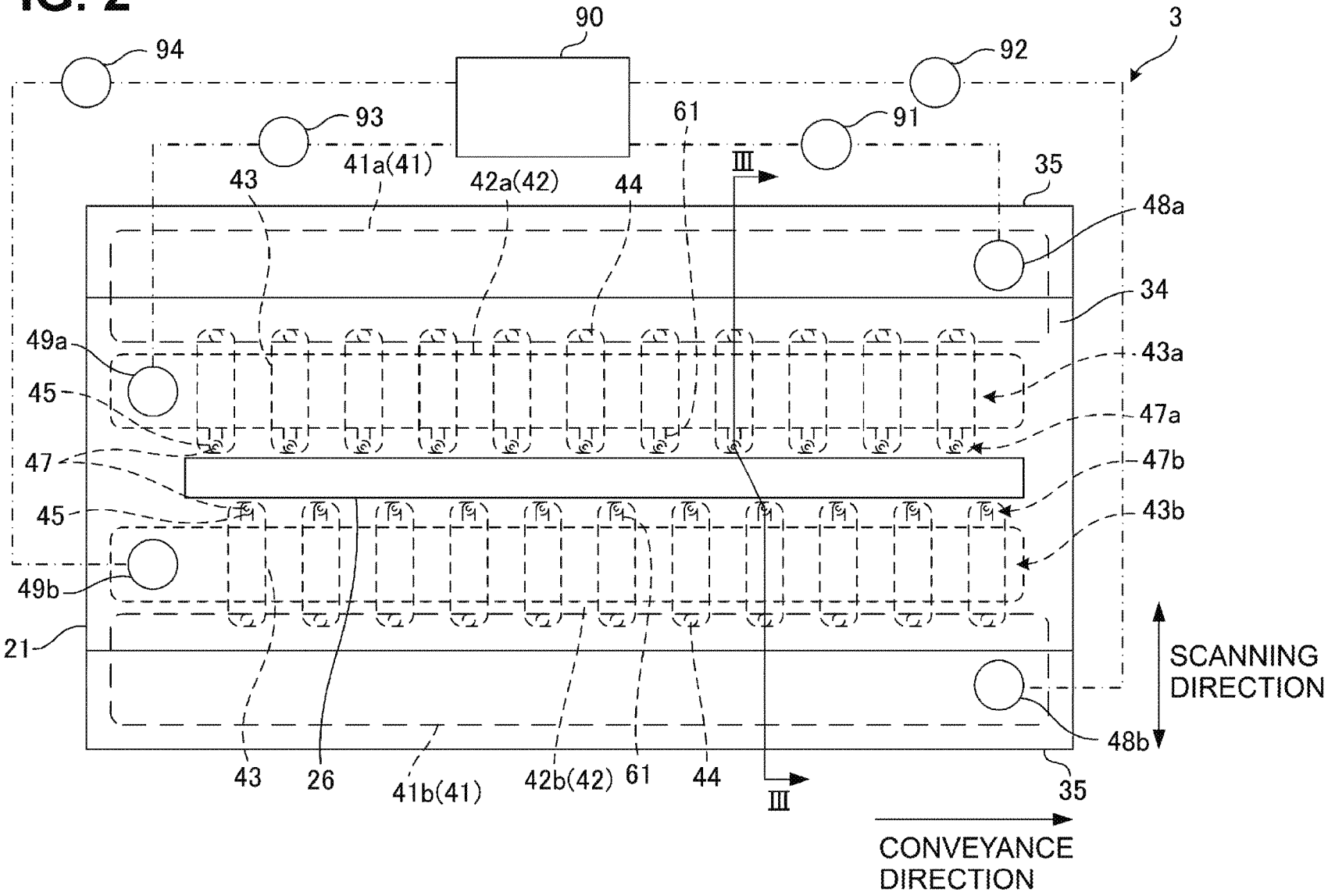
FIG. 2 is a plan view of the inkjet head illustrated in FIG. 1.
Figure 3:
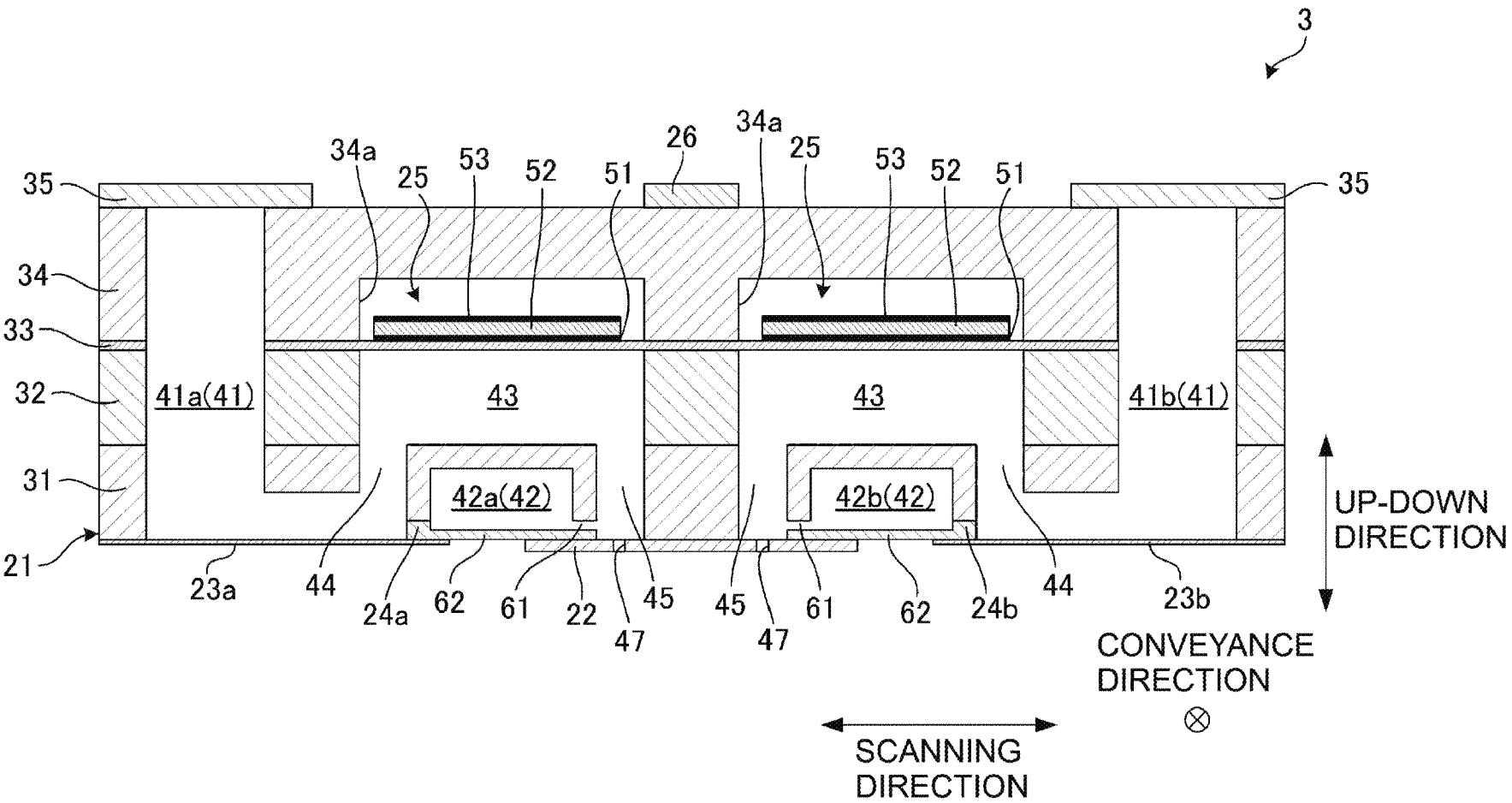
FIG. 3 is a sectional view of the inkjet head taken along a line III-III of FIG. 2.

Referring to FIGS. 2 and 3, a structure of the inkjet head 3 will be described. As illustrated in FIG. 2, the inkjet head 3 is rectangular in form and elongated in the conveyance direction when viewed from the top. As illustrated in FIG. 3, the inkjet head 3 includes a channel member 21, a nozzle plate 22, damper films 23*a*, 23*b*, cover plates 24*a*, 24*b*, piezoelectric elements 25, and a driver IC 26. The inkjet head 3 is supplied with ink from an ink tank 90 (FIG. 2).

As illustrated in FIG. 3, the channel member 21 is formed by stacking plates 31, 32, a vibrating plate 33, a protective substrate 34, and lidding members 35. The plates 31, 32, the vibrating plate 33, the protective substrate 34, and the lidding members 35 are stacked one on another from below in this order. As illustrated in FIG. 2, the channel member 21 includes two lidding members 35. Each of the lidding members 35 is rectangular in form and elongated in the conveyance direction, and is jointed to a corresponding one of ends of the protective substrate 34 in the scanning direction. The nozzle plate 22, the damper films 23*a*, 23*b*, and the cover plates 24*a*, 24*b* are joined to a lower surface of the channel member 21, that is, a lower surface of the plate 31. The damper films 23*a*, 23*b* and the cover plates 24*a*, 24 are disposed on the same side of the channel member 21 as the nozzle plate 22 in the up-down direction.

As illustrated in FIGS. 2 and 3, the channel member 21 includes two first manifolds 41*a*, 41*b*, a plurality of pressure chambers 43, a plurality of descending channels 45, and two second manifolds 42*a*, 42*b*. In the following description, the two first manifolds 41*a*, 41*b* may be just referred to as first manifolds 41 when treated as the same or a first manifold 41 when the description is focused on one side of the channel member 21. Similarly, the two second manifolds 42*a*, 42*b* may be just referred to as second manifolds 42 when treated as the same or a second manifold 42 when the description is focused on one side of the channel member 21.

Each of the two first manifolds 41*a*, 41*b* extends in the conveyance direction and is located in an end portion of the channel member 21 in the scanning direction. The first manifold 41*a* is located on one side (or a left side in FIG. 3) of the channel member 21 in the scanning direction. The first manifold 41*b* is located on the other side (e.g., a right side in FIG. 3) of the channel member 21 in the scanning direction. As illustrated in FIG. 3, the first manifolds 41 each have a cross section parallel to the up-down direction and the scanning direction. The cross section, of which lower end portion extends toward a center of the channel member 21 in the scanning direction, is shaped like a hook.

As illustrated in FIG. 3, an upper surface of each of the first manifolds 41*a*, 41*b* is defined by a corresponding one of the lidding members 35. A lower surface of the first manifold 41*a* is defined by the damper film 23*a* (as an example of a first damper film). A lower surface of the first manifold 41*b* is defined by the damper film 23*b* (as an example of a second damper film). In other words, the damper films 23*a*, 23*b* serve as walls defining the lower surfaces of the first manifolds 41*a*, 41*b*.

The first manifolds 41 are each defined by aligned through holes formed in the plates 31, 32, the vibrating plate 33, and the protective substrate 34, which are located between each of the lidding members 35 and a corresponding one of the damper films 23*a*, 23*b*. Each of the first manifolds 41 has a lower end portion extending toward the center of the channel member 21 in the scanning direction, and the lower end portion is defined by a recessed portion of the plate 31 which is open downward.

The damper films 23*a*, 23*b* are resin films thermally joined to the lower surface of the channel member 21. The damper films 23*a*, 23*b* reduces fluctuations of ink pressure in the first manifolds 41. The damper films 23*a*, 23*b* may be metal films.

As illustrated in FIG. 2, an upper wall of the channel member 21 has supply ports 48*a*, 48*b* at positions overlapping downstream end portions (e.g., right end portions in FIG. 2) of the first manifolds 41*a*, 41*b* in the conveyance direction. A supply port 48*a* is defined by a through hole in the lidding member 35 defining the upper surface of the first manifold 41*a*. A supply port 48*b* is defined by a through hole in the lidding member 35 defining the upper surface of the first manifold 41*b*. The first manifolds 41*a*, 41*b* communicate with the ink tank 90 via tubes, not illustrated, attached to the supply ports 48*a*, 48*b*. Pumps 91, 92 are each located between the ink tank 90 and a corresponding one of the supply ports 48*a*, 48*b* to convey ink from the ink tank 90 toward the supply ports 48*a*, 48*b*.

As illustrated in FIG. 2, the pressure chambers 43 are arranged, between the first manifolds 41*a*, 41*b*, in two pressure-chamber rows 43*a*, 43*b* in a staggered configuration in the conveyance direction. In other words, the pressure-chamber rows 43*a*, 43*b* each including the pressure chambers 43 spaced uniformly in the conveyance direction are arranged alongside in the scanning direction. The pressure chambers 43 in the pressure-chamber row 43*a* and the pressure chamber 43 in the pressure-chamber row 43*b* are located between the first manifold 41*a* and the first manifold 41*b*. As illustrated in FIG. 3, each pressure chamber 43 is defined by a through hole in the plate 32. All the pressure chambers 43 are covered by the vibrating plate 33 stacked onto an upper surface of the plate 32.

The pressure chambers 43 (as an example of first pressure chambers) included in the pressure-chamber row 43*a* on one side in the scanning direction (or an upper row in FIG. 2) communicate with the first manifold 41*a* via supply narrowed portions 44 (each as an example of a first narrowed portion). The first manifold 41*a* is provided in common for the pressure chambers 43 included in the pressure-chamber row 43*a*. Each of the supply narrowed portions 44 is provided for a corresponding one of the pressure chambers 43 in the pressure-chamber row 43*a* and is located between the corresponding one of the pressure chambers 43 and the first manifold 41*a* in the up-down direction. In other words, the supply narrowed portions 44 extend in up-down direction and each connect a lower end of a pressure chamber 43 and an upper end of the first manifold 41*a*. The supply narrowed portions 44 also each connect an end portion of a corresponding pressure chamber 43, on one side in the scanning direction, which are included in the pressure-chamber row 43*a* (or an upper end portion thereof in FIG. 2), and an end portion of the first manifold 41*a* on the other side in the scanning direction (or a lower end portion thereof in FIG. 2).

The pressure chambers 43 (as an example of second pressure chambers) included in the pressure-chamber row 43*b* (or a lower row in FIG. 2) on the other side in the scanning direction (or a lower row in FIG. 2) communicate with the first manifold 41*b* via supply narrowed portions 44 (each as an example of a second narrowed portion). The first manifold 41*b* (as an example of a second manifold for provided in common for the second pressure chambers) is provided in common for the pressure chambers 43 included in the pressure-chamber row 43*b*. The first manifold 41*b* and the first manifold 42*a* sandwich the pressure chambers 43 included in the pressure-chamber row 43*a* and the pressure chambers 43 included in the pressure-chamber row 43*b* therebetween in the scanning direction. Each of the supply narrowed portions 44 is provided for a corresponding one of the pressure chambers 43 in the pressure-chamber row 43*b* and is located between the corresponding one of the pressure chambers 43 and the first manifold 41*b* in the up-down direction. In other words, the supply narrowed portions 44 extend in up-down direction and each connect a lower end of a pressure chamber 43 and an upper end of the first manifold 41*b*. The supply narrowed portions 44 also each connect an end portion of a corresponding pressure chamber 43, on the other side in the scanning direction, which are included in the pressure-chamber row 43*b* (or a lower end portion thereof in FIG. 2) and an end portion of the first manifold 41*a* on one side in the scanning direction (or an upper end portion thereof in FIG. 2).

As illustrated in FIG. 3, each supply narrowed portion 44 is defined by a through hole in the plate 31. More specifically, each supply narrowed portion 44 is defined by a through hole in a deep portion of a recessed portion that is open downward and partially defines a lower end portion of the first manifold 41 in the plate 13.

The descending channels 45 (each as an example of a first descending channel) connected to the pressure chambers 43 included in the pressure-chamber row 43*a* are located between the first manifold 41*a* and the first manifold 41*b* in the scanning direction. The descending channels 45 are located opposite to the first manifold 41*a* relative to the pressure chambers 43 included in the pressure-chamber row 43*a* in the scanning direction. The descending channels 45 are also each connected to an end portion of a corresponding pressure chamber 43 on the other side in the scanning direction (or a lower end portion thereof in FIG. 2).

The descending channels 45 (each as an example of a second descending channel) connected to the pressure chambers 43 included in the pressure-chamber row 43*b* are located between the descending channels 45 connected to the pressure chambers 43 included in the pressure-chamber row 43*a* and the first manifold 41*b* in the scanning direction. The descending channels 45 are located opposite to the first manifold 41*b* relative to the pressure chambers 43 included in the pressure-chamber row 43*b* in the scanning direction. The descending channels 45 are also each connected to an end portion of a corresponding pressure chamber 43 on one side in the scanning direction (or an upper end portion thereof in FIG. 2).

Each of the descending channels 45 is provided for a corresponding one of the pressure chambers 43. As illustrated in FIG. 3, the descending channels 45 are defined by through holes in the plate 31 and each extend downward from a lower end of a pressure chamber 43. Each descending channel 45 is connected at its lower end to a nozzle 47.

As illustrated in FIG. 3, nozzles 47 are formed in the nozzle plate 22 joined to the lower surface of the channel member 21. The nozzle plate 22 is made of a material including silicon and, as illustrated in FIG. 2, has two nozzle rows 47*a*, 47*b* each including a plurality of nozzles 47 arranged uniformly in the conveyance direction. The nozzle rows 47*a*, 47*b* are arranged alongside in the scanning direction. The nozzles 47 in the nozzle row 47*a* (as an example of a first row) fluidly communicate with the pressure chambers 43 included in the pressure-chamber row 43*a*. Each of the nozzles 47 included in the nozzle row 47*a* and a corresponding one of the pressure chambers 43 are connected to a corresponding one of the descending channels 45. The nozzles 47 in the nozzle row 47*b* (as an example of a second row) fluidly communicate with the pressure chambers 43 included in the pressure-chamber row 43*b*. Each of the nozzles 47 included in the nozzle row 47*b* and a corresponding one of the pressure chambers 43 are connected to a corresponding one of the descending channels 45. That is, the nozzle row 47*a* is associated with the pressure chambers 43 included in the pressure-chamber row 43*a*, and the nozzle row 47*b* is associated with the pressure chambers 43 included in the pressure-chamber row 43*b*.

The second manifold 42*a* (as an example of a third manifold) is located between the first manifold 41*a* and the descending channels 45, which are connected to the pressure chambers 43 included in the pressure-chamber row 43*a*, in the scanning direction. As illustrated in FIG. 2, the second manifold 42*a* extends in the conveyance direction and is located overlapping the pressure chambers 43 included in the pressure-chamber row 43*a* when viewed from the top. As illustrated in FIG. 3, the second manifold 42*a* is located below the pressure chambers 43 included in the pressure-chamber row 43*a*.

The second manifold 42*b* (as an example of a fourth manifold) is located between the first manifold 41*b* and the descending channels 45, which are connected to the pressure chambers 43 included in the pressure-chamber row 43*b*, in the scanning direction. As illustrated in FIG. 2, the second manifold 42*b* extends in the conveyance direction and is located overlapping the pressure chambers 43 included in the pressure-chamber row 43*b* when viewed from the top. As illustrated in FIG. 3, the second manifold 42*b* is located below the pressure chambers 43 included in the pressure-chamber row 43*b*.

As illustrated in FIG. 3, each of the second manifolds 42*a*, 42*b* is defined by a recessed portion that is formed in the plate 31 and open downward. A lower surface of the second manifold 42*a* is defined by the cover plate 24*a* (as an example of a first cover plate) joined to the lower surface of the plate 31. A lower surface of the second manifold 42*b* is defined by the cover plate 24*b* (as an example of a second cover plate) joined to the lower surface of the plate 31. In other words, the cover plates 24*a*, 24*b* serve as walls defining the lower surfaces of the second manifolds 42.

The pressure chambers 43 and a second manifold 42 are separated by a partition wall having a thickness of, preferably, 40 μm or greater and 100 μm or smaller.

Similarly, the descending channels 45 and a second manifold 42 are separated by a partition wall having a thickness of, preferably, 40 μm or greater and 100 μm or smaller.

As illustrated in FIG. 2, the upper wall of the channel member 21 has return ports 49*a*, 49*b* at positions overlapping upstream end portions (e.g., left end portions in FIG. 2) of the second manifolds 42*a*, 42*b* in the conveyance direction. The return ports 49*a*, 49*b* are defined by aligned through holes each formed in the plates 31, 32, the vibrating plate 33, and the protective substrate 34. The second manifolds 42*a*, 42*b* communicate with the ink tank 90 via tubes, not illustrated, attached to the return ports 49*a*, 49*b*. Pumps 93, 94 are each located between the ink tank 90 and a corresponding one of the return ports 49*a*, 49*b* to convey ink from the ink tank 90 toward the return ports 49*a*, 49*b*.

Figure 4:
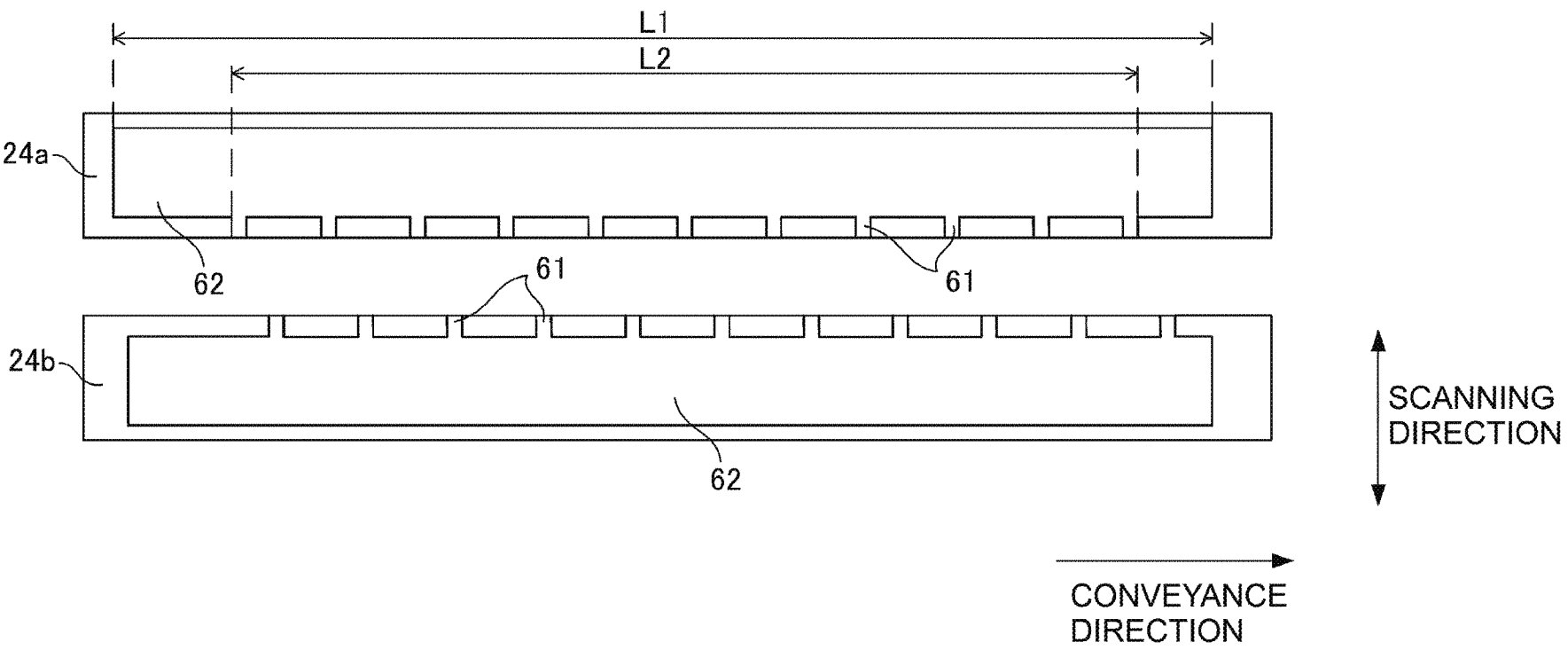
FIG. 4 is a plan view of cover plates illustrated in FIG. 3.

Referring to FIG. 4, the cover plates 24*a*, 24*b* will be described. The cover plates 24*a*, 24*b* are made of resin and joined to the lower surface of the plate 31 in such a manner as to cover openings of the recessed portions formed in the plate 31 and thus define the second manifolds 42*a*, 42*b*. As illustrated in FIG. 3, the cover plate 24*a* does not overlap the first manifold 41*a* and the descending channels 45 communicating with the first manifold 41*a*, when viewed from the top. Similarly, the cover plate 24*b* does not overlap the first manifold 41*b* and the descending channels 45 communicating with the first manifold 41*b*, when viewed from the top. The cover plates 24*a*, 24*b* are equal in length in the conveyance direction to the channel member 21.

The cover plate 24*a* has recessed portions that are open upward and define return narrowed portions 61 (each as an example of a third narrowed portion) allowing the second manifold 42*a* to communicate with the descending channels 45 connected to the pressure chambers 43 included in the pressure-chamber row 43*a*. In other words, the first manifold 41*a* communicates with the second manifold 42*a* via the supply narrowed portions 44, the pressure chambers 43, the descending channels 45, and the return narrowed portions 61. The second manifold 42*a* is provided in common for the pressure chambers 43 included in the pressure-chamber row 43*a*. Each of the return narrowed portions 61 is provided for a corresponding one of the descending channels 45 and is located between the corresponding one of the descending channels 45 connected to the pressure chambers 43 included in the pressure-chamber row 43*a* and the second manifold 42*a*. Each of the return narrowed portions 61 thus extends in a direction crossing a corresponding supply narrowed portion 44. In other words, each of the supply narrowed portions 44 extends in a direction crossing a direction in which a corresponding return narrowed portion 61 extends from its associated descending channel 45 to the second manifold 42*a*.

The cover plate 24*b* has recessed portions that are open upward and define the return narrowed portions 61 (each as an example of a fourth narrowed portion) allowing the second manifold 42*b* to communicate with the descending channels 45 connected to the pressure chambers 43 included in the pressure-chamber row 43*b*. In other words, the first manifold 41*b* communicates with the second manifold 42*b* via the supply narrowed portions 44, the pressure chambers 43, the descending channels 45, and the return narrowed portions 61. The second manifold 42*b* is provided in common for the pressure chambers 43 included in the pressure-chamber row 43*b*. Each of the return narrowed portions 61 is provided for a corresponding one of the descending channels 45 and is located between the corresponding one of the descending channels 45 connected to the pressure chambers 43 included in the pressure-chamber row 43*b* and the second manifold 42*b*. Each of the return narrowed portions 61 thus extends in a direction crossing a corresponding supply narrowed portion 44. In other words, each of the supply narrowed portions 44 extends in a direction crossing a direction in which a corresponding return narrowed portion 61 extends from its associated descending channel 45 to the second manifold 42*b*.

Each of the return narrowed portions 61 is provided for a corresponding one of the descending channels 45 connected to the pressure chambers 43. As illustrated in FIG. 2, the return narrowed portions 61 are provided each in association with a corresponding one of the pressure chambers 43 included in each of the pressure-chamber rows 43*a*, 43*b*, and arranged in the conveyance direction in the same manner as the pressure chambers 43.

The cover plates 24*a*, 24*b* have respective damper areas 62 to reduce fluctuations of ink pressure in the second manifolds 42*a*, 42*b*. The damper areas 62 are defined by recessed portions, which are open upward. The cover plates 24*a*, 24*b* are thus thinner at the damper areas 62 than at other areas except for the damper areas 62.

As illustrated in FIG. 4, the damper area 62 in the cover plate 24*a* that defines the lower surface of the second manifold 42*a* communicates with all the return narrowed portions 61 that communicate with the descending channels 45 connected to the pressure chambers 43 included in the pressure-chamber row 43*a*. The damper area 62 in the cover plate 24*b* that defines the lower surface of the second manifold 42*b* communicates with all the return narrowed portions 61 that communicate with the descending channels 45 connected to the pressure chambers 43 included in the pressure-chamber row 43*b*. In other words, each of the cover plates 24*a*, 24*b* has one damper area 62 that communicates with the return narrowed portions 61.

As illustrated in FIG. 4, the damper areas 62 are rectangular in form and elongated in the conveyance direction when viewed from the top. Each of the damper areas 62 has a length L1, which is longer in the conveyance direction than a length L2 between the two return narrowed portions 61 farthest away from each other in the conveyance direction among the return narrowed portions 61 communicating with the damper area 62.

As illustrated in FIG. 3, the damper film 23*a* and the nozzle plate 22 do not overlap each other when viewed from the top. Similarly, the damper film 23*b* and the nozzle plate 22 do not overlap each other when viewed from the top. The damper film 23*a* is thermally joined, at its end on the other side in the scanning direction (or its right end in FIG. 3), to the lower surface of the cover plate 24*a*. The damper film 23*b* is thermally joined, at its end on one side in the scanning direction (or its left end in FIG. 3), to the lower surface of the cover plate 24*b*. The nozzle plate 22 is joined to the lower surface of the cover plate 24*a* at its end on one side in the scanning direction (or its left end in FIG. 3), and to the lower surface of the cover plate 24*b* at its end on the other side in the scanning direction (or its right end in FIG. 3).

An upper surface of the vibrating plate 33 has an area corresponding to the pressure chambers 43 included in each of the pressure-chamber rows 43*a*, 43*b*. In the area, a common electrode 51, a piezoelectric member 52, and individual electrodes 53 are stacked from below in this order. The common electrode 51 and the piezoelectric member 52 are provided for each of the pressure-chamber rows 43*a*, 43*b*, and extend over the pressure chambers 43 included in each of the pressure-chamber rows 43*a*, 43*b*. Each of the individual electrodes 53 is provided for a corresponding one of the pressure chambers 43 and overlaps the corresponding pressure chamber 43 when viewed from the top. An individual electrode 53, a portion of the common electrode 51 facing the individual electrode 53, and a portion of the piezoelectric member 52 facing the individual electrode 53 form a single piezoelectric element 25. In other words, piezoelectric elements 25 are disposed on the upper surface of the vibrating plate 33 each in association with a corresponding one of the pressure chambers 43.

The protective substrate 34 stacked onto the upper surface of the vibrating plate 33 has two recessed portions 34*a* that are open downward and each define a space for storing the piezoelectric elements 25. Each of the two recessed portions 34*a* stores a common electrode 51, a piezoelectric member 52, and individual electrodes 53, which are provided for a corresponding one of the pressure-chamber rows 43*a*, 43*b*.

The driver IC 26 is disposed on an upper surface of the protective substrate 34. The driver IC 26 is located between the two recessed portions 34*a* in the scanning direction. As illustrated in FIG. 2, the driver IC 26 extends in the conveyance direction. The driver IC 26 is connected, at its one end in the conveyance direction (e.g. at its left end in FIG. 2), to one end of a wiring substrate (not illustrated) such as a flexible printed circuit (FPC). The wiring board is connected at its other end to a control board (not illustrated). The driver IC 26 is connected to the control board via the wiring substrate.

The common electrode 51 and the individual electrodes 53, which are provided for each of the pressure-chamber rows 43*a*, 43*b*, are electrically connected to the driver IC 26 via electrodes (not illustrated) passing through the protective substrate 34. The driver IC 26, which maintains the potential of the common electrode 51 at a ground potential, changes the potential of each of the individual electrodes 53. The individual electrode 53 whose potential is changed causes a corresponding piezoelectric member 52 to become deformed, and thus a portion of the vibrating plate 33 overlapping the deformed piezoelectric member 52 in the up-down direction protrudes toward a corresponding pressure chamber 43. The pressure chamber 43 is thus reduced in volume and the pressure of ink in the pressure chamber 43 rises, so that ink is ejected from a nozzle 47 communicating with the pressure chamber 43 in form of droplets.

Circulation of ink between the inkjet head 3 and the ink tank 90 will be described. Driving of the pumps 91, 92 allows ink in the ink tank 90 to enter first manifolds 41*a*, 41*b* through the supply ports 48*a*, 48*b*. Ink stored in the first manifolds 41*a*, 41*b* is supplied via the supply narrowed portions 44 to the pressure chambers 43. Ink flowing out from the first manifolds 41*a*, 41*b* enters the second manifolds 42*a*, 42*b* through the supply narrowed portions 44, the pressure chambers 43, the descending channels 45, and the return narrowed portions 61. Driving of the pumps 93, 94 allows ink in the second manifolds 42*a*, 42*b* to return to the ink tank 90 through the return ports 49*a*, 49*b*.

First Embodiment Features

As described above, the inkjet head 3 of the first embodiment includes the channel member 21, the nozzle plate 22, the damper films 23*a*, 23*b*, and the cover plates 24*a*, 24*b*. The channel member 21 includes the pressure chambers 43, the descending channels 45 each connected to a corresponding one of the pressure chambers 43, the first manifolds 41 each provided in common for the pressure chambers 43 and located opposite to the descending channels 45 relative to each of the pressure chambers 43 in the scanning direction, and the second manifolds 42 each provided in common for the pressure chambers 43. The nozzle plate 22 has the nozzles 47 each connected to a corresponding one of the descending channels 45. The damper films 23*a*, 23*b* define the lower surfaces of the first manifolds 41. The cover plates 24*a*, 24*b* define the lower surfaces of the second manifolds 42. The nozzle plate 22 and the damper films 23*a*, 23*b* do not overlap one another when viewed from the top, and are joined to the cover plates 24*a*, 24*b*.

The lower surfaces of the second manifolds 42 are defined by the resin-made cover plates 24*a*, 24*b*, which are lower per piece than the nozzle plate 22 including silicon, thus preventing increase in material cost. As the damper films 23*a*, 23*b* are designed to be joined to the cover plates 24*a*, 24*b* only on their one side, their one side only requires surface finishing. In other words, there is no need to finish their both sides for joining to other members. Even when the damper films 23*a*, 23*b* are resin films or metal films, they can be joined to the cover plates 24*a*, 24*b* with low surface finishing cost. This provides the second manifolds 42 while preventing increase in manufacturing cost.

In this embodiment, the cover plates 24*a*, 24*b* have the return narrowed portions 61 communicating with the second manifolds 42. The flow rate of ink entering the second manifolds 42 may be adjusted by adjusting the size of each return narrowed portion 61.

In this embodiment, each of the return narrowed portions 61 is provided in association with a corresponding one of the descending channels 45, and the second manifolds 42 communicate with each of the descending channels 45 via a corresponding one of the return narrowed portions 61. The return narrowed portions 61 prevent the pressure from escaping from the nozzles 47 connected to the descending channels 45 when ink is ejected from the nozzles 47 in form of droplets.

In addition, this embodiment shows that the cover plates 24*a*, 24*b* have the damper areas 62 communicating with the return narrowed portions 61. Each damper area 62 is a recessed portion having a length L1, which is longer in the conveyance direction than a length L2 between the two farthest return narrowed portions 61 among the return narrowed portions 61. Unlike this embodiment, if the length L1 of each damper area 62 is shorter than the length L2, an effect of the damper area 62 on the return narrowed portions 61 may vary between a return narrowed portion 61 within the confines of the length L1 and a return narrowed portion 61 outside the confines of the length L1. Attenuation characteristics of vibrations remaining in a channel corresponding to a return narrowed portion 61 after droplet ejection may vary according to whether the return narrowed portion 61 is within the confines of the length L1 or outside the confines of the length L1. This complicates design of flow resistance in the return narrowed portions 61. If the length L2 between the two farthest return narrowed portions 61 is longer than the length L1 of each damper area 62, the attenuation characteristics of vibrations in all return narrowed portions 61 after droplet ejection is unlikely to vary. This simplifies design of flow resistance in the return narrowed portions 61. Thus, ink ejection performance is likely to balance with output of the pumps 91, 92 that send ink to the first manifolds 41.

This embodiment further shows that the cover plates 24*a*, 24*b* each have a damper area 62 to reduce fluctuations of ink pressure in the second manifolds 42*a*, 42*b*. This ensures damper performance of the second manifolds 42*a*, 42*b*.

In this embodiment, the return narrowed portions 61 and the damper areas 62 are formed by the recessed portions in the cover plates 24*a*, 24*b*. This provides the return narrowed portions 61 and the damper areas 62 without the need to increase the number of components.

In this embodiment, the damper area 62 of each cover plate 24*a*, 24*b* is less in number than the return narrowed portions 61. This structure leads to enhanced damper performance compared to a structure where each cover plate 24*a*, 24*b* has a damper area 62 in correspondence with a return narrowed portion 61.

In this embodiment, the second manifolds 42 are located overlapping the pressure chambers 43 when viewed from the top. This contributes to reducing the size of the inkjet head 3 compared to a structure where the second manifolds 42 are located away from the pressure chambers 43 when viewed from the top.

In addition, this embodiment shows that the pressure chambers 43 and a second manifold 42 are separated by a partition wall having a thickness of 40 μm or greater. The thickness can reduce damping at the partition wall separating the pressure chambers 43 and the second manifold 42, thus preventing degradation in ink ejection performance from the nozzles 47.

This embodiment further shows that the descending channels 45 and a second manifold 42 are separated by a partition wall having a thickness of 40 μm or greater. The thickness can reduce damping at the partition wall separating the descending channels 45 and the second manifold 42, thus preventing degradation in ink ejection performance from the nozzles 47.

In this embodiment, a first manifold 41 is a supply manifold to supply ink to the pressure chambers 43, and a second manifold 42 is a return manifold to allow ink flowing out from the first manifold 41 to enter. This allows supplied ink to return for circulation and reduces problems such as an increased viscosity of ink and settlement of some particles contained in ink.

Second Embodiment

Figure 5:
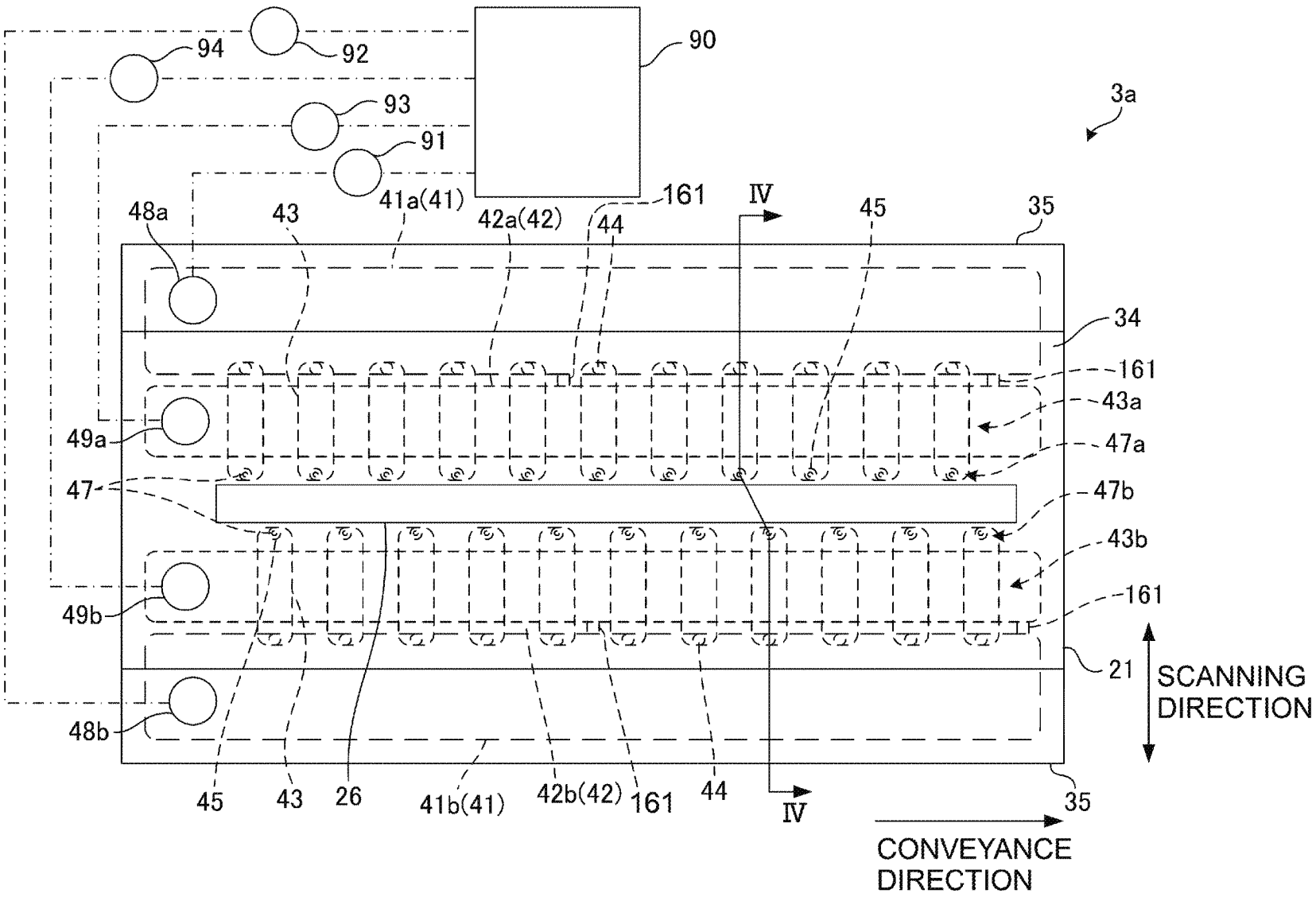
FIG. 5 is a plan view of an inkjet head according to a second embodiment of the disclosure.
Figure 6:
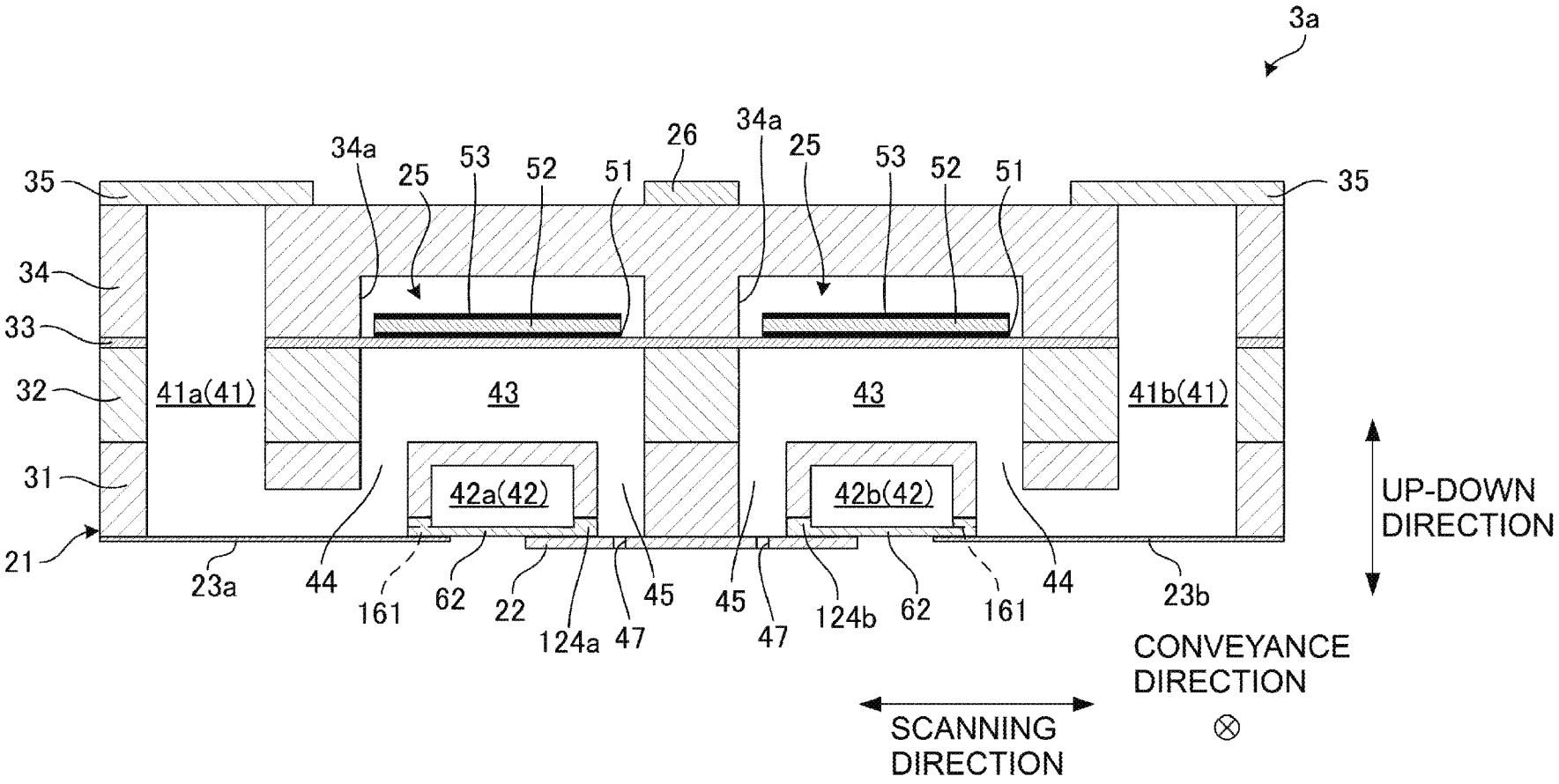
FIG. 6 is a sectional view of the inkjet head taken along a line VI-VI of FIG. 5.

Referring to FIGS. 5 and 6, a second embodiment will be described. The second embodiment is different from the first embodiment in locations of return narrowed portions 161. Components similar to or identical with, in structure, those illustrated and described in the first embodiment are designated by similar numerals, and thus the description thereof can be omitted from the sake of brevity.

In an inkjet head 3*a* of the second embodiment, a cover plate 124*a* that defines the lower surface of the second manifold 42*a* has two recessed portions that are open upward. The recessed portions define respective return narrowed portions 161 (as an example of third narrowed portions) each allowing the first manifold 41*a* and the second manifold 42*a* to communicate with each other. The return narrowed portions 161 each connect an end portion of the first manifold 41*a* on the other side in the scanning direction (or a lower end portion thereof in FIG. 6) and an end portion of the second manifold 42*a* on one side in the scanning direction (or an upper end portion thereof in FIG. 6).

A cover plate 124*b* that defines the lower surface of the second manifold 42*b* has two recessed portions that are open upward. The recessed portions define respective return narrowed portions 161 (as an example of fourth narrowed portions) each allowing the first manifold 41*b* and the second manifold 42*b* to communicate with each other. The return narrowed portions 161 each connect an end portion of the first manifold 41*b* on one side in the scanning direction (or an upper end portion thereof in FIG. 6) and an end portion of the second manifold 42*b* on the other side in the scanning direction (or a lower end portion thereof in FIG. 6).

As illustrated in FIG. 5, two return narrowed portions 161 in each cover plate 124*a*, 124*b* are located between a first manifold 41 and a second manifold 42: one is in a central portion in the conveyance direction; and the other one is in a downstream end portion in the conveyance direction (or a right end portion in FIG. 5). In this embodiment, the supply ports 48*a*, 48*b* for supplying ink to the first manifolds 41*a*, 41*b* are located at positions facing upstream end portions of the first manifolds 41*a*, 41*b* in the conveyance direction (or left end portions thereof in FIG. 5) when viewed from the top.

Of the two return narrowed portions 161 in each cover plate 124*a*, 124*b*, the following describes a location of a return narrowed portion 161 that is located farther away from a corresponding supply port 48*a*, 48*b* or that allows downstream end portions of a first manifold 41 and a second manifold 42 in the conveyance direction (or right end portions thereof in FIG. 5) to communicate with each other. The farther return narrowed portion 161 is located opposite to the supply port 48*a*, 48*b* relative to a pressure chamber 43 located farthest away from the supply port 48*a*, 48*b* in the conveyance direction or a most downstream pressure chamber 43 (or a rightmost one in FIG. 5) in the conveyance direction.

Circulation of ink between the inkjet head 3*a* and the ink tank 90 will be described. Driving of the pumps 91, 92, 93, 94 allows ink in the ink tank 90 to enter the first manifolds 41*a*, 41*b* through the supply ports 48*a*, 48*b*. Ink stored in the first manifolds 41*a*, 41*b* enters the second manifolds 42*a*, 42*b* through respective return narrowed portions 161. Ink in the second manifolds 42*a*, 42*b* returns to the ink tank 90 through the return ports 49*a*, 49*b*.

Second Embodiment Features

As with the first embodiment, even when the damper films 23*a*, 23*b* are resin films or metal films, this embodiment also provides the second manifolds 42 while preventing increase in size and manufacturing cost.

In this embodiment, the second manifold 42 and the first manifold 41 communicate with each other via the return narrowed portions 161. Ink in the first manifold 41 is thus circulated.

In this embodiment, the farther return narrowed portion 161 away from the supply port 48*a*, 48*b* is located opposite to the support port 48*a*, 48*b* relative to the farthest pressure chamber 43 from the support port 48*a*, 48*b* in the conveyance direction. Thus, ink in the first manifold 41 can be circulated through the pressure chambers 43 including the farthest pressure chamber 43 located away from the supply port 48*a*, 48*b*.

The above embodiments described in accordance with the drawings are merely examples. Various changes, arrangements and modifications may be applied therein without departing from the spirit and scope of the disclosure.

The first and second embodiments show but are not limited to the channel member 21 having two first manifolds 41 and two second manifolds 42. The channel member 21 may have one first manifold 41 and one second manifold 42.

The first and second embodiments show but are not limited to cover plates 24*a*, 24*b* (124*a*, 124*b*) each having return narrowed portions 61 (161) formed therein. The return narrowed portions 61 (161) may be formed in the plate 31.

The first embodiment shows that a damper area 62 communicates with a plurality of return narrowed portions 61. In other words, the damper area 62 in the cover plate 24*a* communicates with all the return narrowed portions 61 that communicate with the descending channels 45 connected to the pressure chambers 43 included in the pressure-chamber row 43*a*. The damper area 62 in the cover plate 24*b* communicates with all the return narrowed portions 61 that communicate with the descending channels 45 connected to the pressure chambers 43 included in the pressure-chamber row 43*b*. However, the first embodiment is not limited to these structures.

Figure 7A:
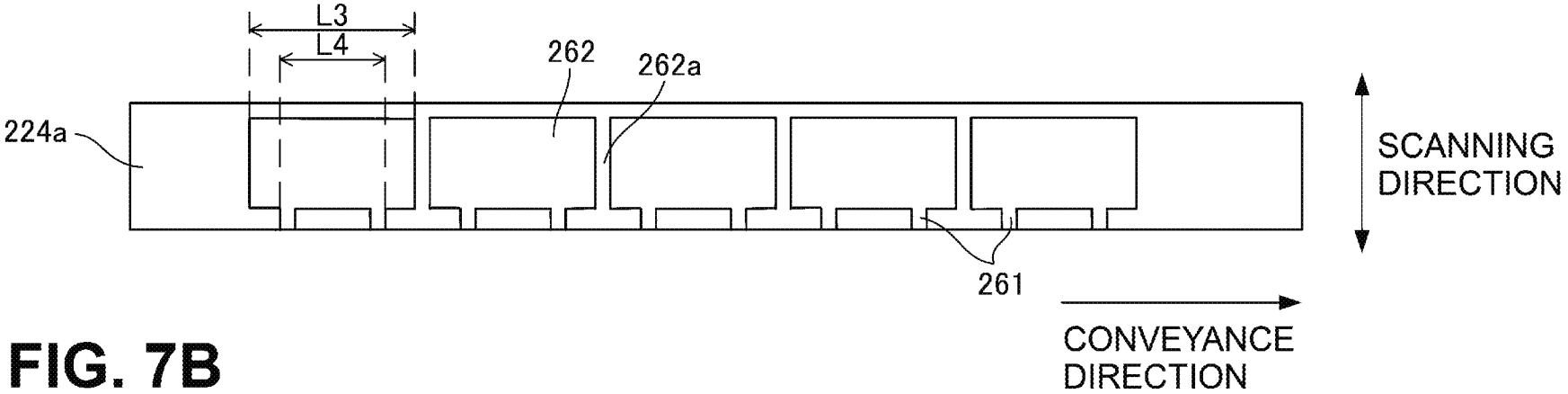
FIG. 7A is a plan view of a cover plate according to a first modification of the first embodiment.

As illustrated in FIG. 7A, a cover plate 224*a* according to a first modification of the first embodiment has five damper areas 262 arranged in the conveyance direction. Partition walls 262*a* each separate adjacent two of the damper areas 262 in the conveyance direction and extend in the scanning direction over the entire length of a corresponding damper area 262. Each of the damper areas 262 communicates with adjacent two of the return narrowed portions 261. Each of the damper areas 262 has a length L3, which is longer in the conveyance direction than a length L4 between the adjacent two of the return narrowed portions 261. The damper areas 262 according to this modification are each relatively small in aspect ratio, thus leading to enhanced damper performance.

Figure 7B:
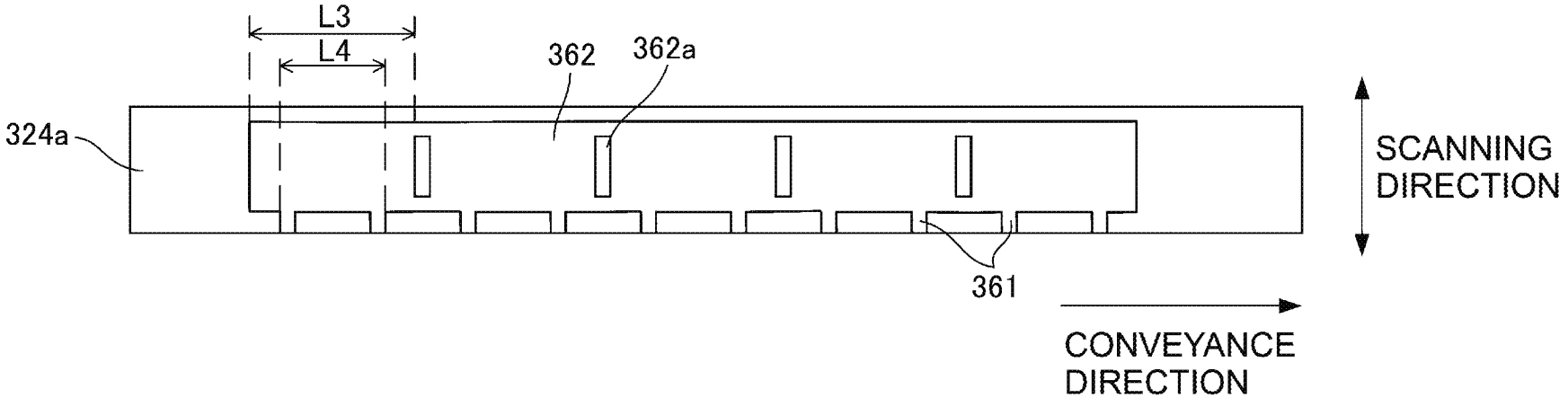
FIG. 7B is a plan view of a cover plate according to a second modification of the first embodiment.

As illustrated in FIG. 7B, a cover plate 324*a* according to a second modification of the first embodiment, has five damper areas 362 arranged in the conveyance direction, each communicating with adjacent two of return narrowed portions 361, as with the first modification. Partition walls 362*a* each separate adjacent two of the damper areas 362 in the conveyance direction. Each of the partition walls 362*a* is shorter than the entire length of a corresponding damper area 362 in the scanning direction. In this modification, the damper areas 362 adjacent to one another in the conveyance direction are connected at their both ends in the scanning direction. The damper areas 362 adjacent to one another in the conveyance direction may be connected at their one ends in the scanning direction.

The first embodiment and the first and second modifications thereof show but are not limited to one damper area 62 (262, 362) communicating with return narrowed portions 61 (261, 361). The number of damper areas 62 (262, 362) is preferably less than that of return narrowed portions 61 (261, 361). Alternatively, the damper areas 62 (262, 362) may be provided in equal number to the return narrowed portions 61 (261, 361).

The second embodiment shows but is not limited to each cover plate 124*a*, 124*b* having two return narrowed portions 161. The number of return narrowed portions 161 provided for each cover plate 124*a*, 124*b* may be one, or three or more.

The second embodiment shows but is not limited to that the farthest return narrowed portion 161 away from the supply port 48*a*, 48*b* in the conveyance direction is located opposite to the supply port 48*a*, 48*b* relative to the pressure chamber 43 farthest away from the supply port 48*a*, 48*b*. In this embodiment, the return narrowed portion 161 farthest away from the supply port 48*a*, 48*b* in the conveyance direction may be located on the same side of the pressure chamber 43 farthest away from the supply port 48*a*, 48*b* as the supply port 48*a*, 48*b* is.

The first and second embodiments show but are not limited to that the cover plate 24*a*, 24*b* (124*a*, 124*b*) has a damper area 62 to reduce fluctuations of ink pressure in its associated second manifold 42. The cover plate 24*a*, 24*b* (124*a*, 124*b*) may be devoid of the damper area 62.

The first and second embodiments show but are not limited to that the return narrowed portions 61 (161) and the damper area 62 are defined by recessed portions formed in each cover plate 24*a*, 24*b* (124*a*, 124*b*). Each the cover plate 24*a*, 24*b* (124*a*, 124*b*) may be replaced with two plates, upper and lower plates, and the upper plate may have through holes defining the return narrowed portions 61 (161) and the damper area 62.

In addition, the first and second embodiments show but are not limited to that each second manifold 42 is located overlapping the pressure chambers 43 when viewed from the top. Each second manifold 42 may not overlap the pressure chambers 43 when viewed from the top.

Figure 8:
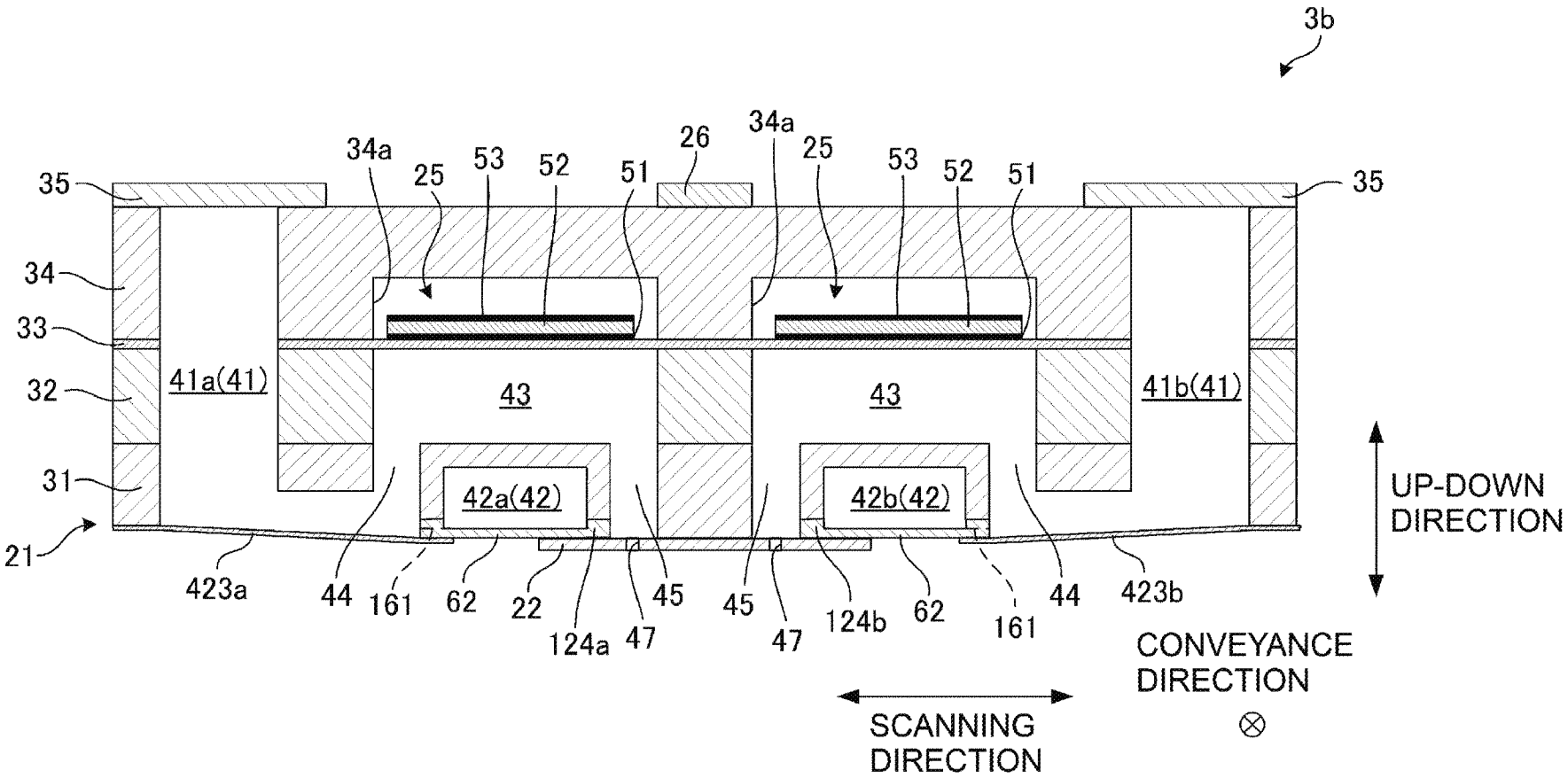
FIG. 8 is a sectional view of an inkjet head according to a modification of the second embodiment.

As illustrated in FIG. 8, an inkjet head 3*b* according to a modification of the second embodiment includes damper films 423*a*, 423*b* that define the lower surfaces of the first manifolds 41. The damper films 423*a*, 423*b* are inclined downward toward the nozzle plate 22 in the scanning direction. This modification prevents sediments form forming in the first manifolds 41.

The first and second embodiments show but are not limited to that a partition wall separating the pressure chambers 43 and a second manifold 42 and a partition wall separating the descending channels 45 and a second manifold 42 each have a thickness of 40 μm or greater. The thickness of the separation walls may be smaller than 40 μm.

In the first and second embodiments, the first manifold 41, which is located opposite to the descending channels 45 relative to each of the pressure chambers 43 in the scanning direction, is a supply manifold to supply ink to the pressure chambers 43. The second manifold 42, which is located between the first manifold 41 and each of the descending channels 45 in the scanning direction, is a return manifold to allow ink flowing out from the first manifolds 41 to enter. The return manifold may be located opposite to the descending channels 45 relative to each of the pressure chambers 43 in the scanning direction, while the supply manifold may be located between the return manifold and each of the descending channels in the scanning direction.

The actuator is not limited to a piezoelectric actuator with piezoelectric elements, but may be other type actuators, such as a thermal actuator using a thermal element, and an electrostatic actuator using electrostatic force.

The printer 1 is not limited to a serial printer. The printer 1 may be a line printer with stationary heads in which ink is ejected from nozzles at fixed positions in form of droplets.

A liquid to be ejected from nozzles in form of droplets is not limited to ink, but may be any liquids, for example, a process liquid for condensation or precipitation of an ink component. The target object is not limited to a sheet P, but may be, for example, a cloth, a substrate, and other materials.

The disclosure may be applied to not only printers but also other apparatus such as a facsimile, a copier, and a multifunction apparatus. The disclosure may be applied to various liquid ejection devices intended for, not only image recording on sheets, but also conductive pattern forming on substrates to form conductive patterns on substrates by ejecting a conductive liquid thereto.

What is claimed is:

1. A liquid ejection head comprises:

a channel member including:

a plurality of pressure chambers arranged in an arrangement direction;

a first manifold provided in common for the pressure chambers;

a plurality of descending channels each connected to a corresponding one of the pressure chambers and located opposite to the first manifold relative to the corresponding one of the pressure chambers in a particular direction orthogonal to the arrangement direction; and a second manifold provided in common for the pressure chambers;

a nozzle plate having a plurality of nozzles each connected to a corresponding one of the descending channels;

a damper film defining a portion of the first manifold; and a cover plate defining a portion of the second manifold, wherein the damper film and the cover plate are disposed on the same side of the channel member as the nozzle plate in an orthogonal direction orthogonal to the particular direction, and wherein the nozzle plate and the damper film do not overlap each other when viewed in the orthogonal direction, and are joined to the cover plate.

2. The liquid ejection head according to claim 1, wherein the cover plate has a narrowed portion communicating with the second manifold.

3. The liquid ejection head according to claim 2, wherein the second manifold and the first manifold communicate with each other via the narrowed portion.

4. The liquid ejection head according to claim 3, further comprising a supply port through which liquid is supplied to the first manifold, wherein the cover plate has a further narrowed portion communicating with the second manifold, the narrowed portion and the further narrowed portion being arranged in the arrangement direction, wherein one of the narrowed portion and the further narrowed portion is located farther away from the supply port than the other one thereof in the arrangement direction, and wherein the one of the narrowed portion and the further narrowed portion is located opposite to the supply port relative to a farthest pressure chamber of the pressure chambers farthest away from the supply port in the arrangement direction.

5. The liquid ejection head according to claim 2, wherein the cover plate has a damper area to reduce liquid pressure in the second manifold.

6. The liquid ejection head according to claim 5, wherein the cover plate has a further damper area to reduce liquid pressure in the second manifold.

7. The liquid ejection head according to claim 6, wherein the cover plate has a plurality of recessed portions, each defining a corresponding one of the narrowed portion, the damper area, and the further damper area.

8. The liquid ejection head according to claim 1, wherein the cover plate has a plurality of narrowed portions communicating with the second manifold, wherein each of the narrowed portions is provided in association with a corresponding one of the descending channels, and wherein the second manifold communicates with each of the descending channels via a corresponding one of the narrowed portions.

9. The liquid ejection head according to claim 8, wherein the narrowed portions are arranged in the arrangement direction and the orthogonal direction, the narrowed portions including a first narrowed portion and a second narrowed portion that are farthest away from each other in the arrangement direction among the narrowed portions, and wherein the cover plate has a recessed portion that communicates with the first narrowed portion and the second narrowed portion, the recessed portion having a length longer in the arrangement direction than a length between the first narrowed portion and the second narrowed portion.

10. The liquid ejection head according to claim 1, wherein the cover plate has one or more narrowed portions communicating with the second manifold and one or more damper areas to reduce liquid pressure in the second manifold, and wherein the one or more narrowed portions are less in number than the one or more damper areas.

11. The liquid ejection head according to claim 1, wherein the second manifold is located overlapping the pressure chambers when viewed in the orthogonal direction.

12. The liquid ejection head according to claim 11, wherein the pressure chambers and the second manifold are separated by a partition wall having a thickness of 40 μm or greater.

13. The liquid ejection head according to claim 12, wherein the descending channels and the second manifold are separated by a partition wall having a thickness of 40 μm or greater.

14. The liquid ejection head according to claim 1, wherein the first manifold is a supply manifold to supply liquid to the pressure chambers, and wherein the second manifold is a return manifold to allow liquid flowing out from the first manifold to enter.

15. A liquid ejection head comprises:

a nozzle plate having a plurality of first nozzles in a first row and a plurality of second nozzles in a second row different from the first row;

a channel member including:

a plurality of first pressure chambers each corresponding to a corresponding one of the first nozzles in the first row;

a plurality of second pressure chambers each corresponding to a corresponding one of the second nozzles in the second row;

a first manifold provided in common for the first pressure chambers;

a second manifold provided in common for the second pressure chambers, the second manifold and the first manifold sandwiching the first pressure chambers and the second pressure chambers therebetween in a particular direction;

a first narrowed portion located between one of the first pressure chambers and the first manifold in an orthogonal direction orthogonal to the particular direction;

a second narrowed portion located between one of the second pressure chambers and the second manifold in the orthogonal direction;

a first descending channel located between the first manifold and the second manifold in the particular direction and connected to one of the first pressure chambers;

a second descending channel located between the first descending channel and the second manifold in the particular direction and connected to one of the second pressure chambers;

a third manifold located between the first manifold and the first descending channel in the particular direction and provided in common for the first pressure chambers;

a fourth manifold located between the second manifold and the second descending channel in the particular direction and provided in common for the second pressure chambers;

a third narrowed portion located between the first descending channel and the third manifold in the particular direction; and a fourth narrowed portion located between the second descending channel and the fourth manifold in the particular direction;

a first damper film defining a portion of the first manifold;

a second damper film defining a portion of the second manifold;

a first cover plate defining a portion of the third manifold; and a second cover plate defining a portion of the fourth manifold, wherein the first narrowed portion extends in a direction crossing a direction in which the third narrowed portion extends from the first descending channel to the third manifold, wherein the second narrowed portion extends in a direction crossing a direction in which the fourth narrowed portion extends from the second descending channel to the fourth manifold, wherein the first damper film, the second damper film, the first cover plate, and the second cover plate are disposed in a portion of the channel member in the orthogonal direction, the portion including the nozzle plate, wherein the nozzle plate and the first damper film do not overlap each other in the orthogonal direction and are joined to the first cover plate, and wherein the nozzle plate and the second damper film do not overlap each other in the orthogonal direction and are joined to the second cover plate.

* * * * *